US006471078B2

(12) United States Patent
Pyle

(10) Patent No.: US 6,471,078 B2
(45) Date of Patent: Oct. 29, 2002

(54) MOBILE PERCUSSION INSTRUMENT FIELD RACK SYSTEM

(76) Inventor: Mark C. Pyle, 23640 N. 104th Ave., Peoria, AZ (US) 85382

( * ) Notice: Subject to any disclaimer, the term of this patent is extended or adjusted under 35 U.S.C. 154(b) by 0 days.

(21) Appl. No.: 09/782,978

(22) Filed: Feb. 13, 2001

(65) Prior Publication Data

US 2002/0108918 A1 Aug. 15, 2002

(51) Int. Cl.[7] ..... A47F 7/00
(52) U.S. Cl. ..... 211/85.6
(58) Field of Search ..... 211/85.6, 13.1, 211/85.7, 85.8; 84/421, 402, 723; 280/79.3

(56) References Cited

U.S. PATENT DOCUMENTS 3,893,363 A * 7/1975 Cohen
3,945,291 A * 3/1976 Zickos
4,579,229 A * 4/1986 Pocaro et al.
5,165,552 A * 11/1992 Muhlbauer
5,182,416 A * 1/1993 Schweizer
5,337,646 A * 8/1994 Austin
5,520,292 A * 5/1996 Lombardi
5,875,652 A * 3/1999 Davis

* cited by examiner

*Primary Examiner*—Alvin Chin-Shue
*Assistant Examiner*—Sarah Purol
(74) *Attorney, Agent, or Firm*—Martin L. Stoneman

(57) ABSTRACT

A mobile percussion-instrument field rack that holds a multiplicity of percussion instruments such that one or more percussionists can play at the same time. The field rack is foldable and easily transported, preferably in between the seats of a bus. It has large wide wheels attached to a center portion of the rack with a fixed stable wheelbase which is independent of swinging and height-adjustable side wings of the rack. It is exceptionally stable and comprises a distinct upper and lower framework which utilizes a two-point clamping system for improved securing of the instruments.

21 Claims, 4 Drawing Sheets

FIG. 11
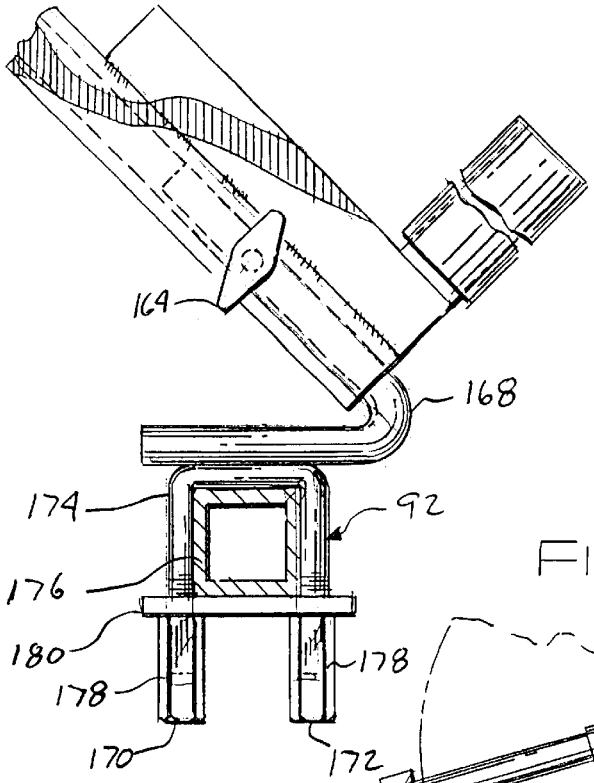
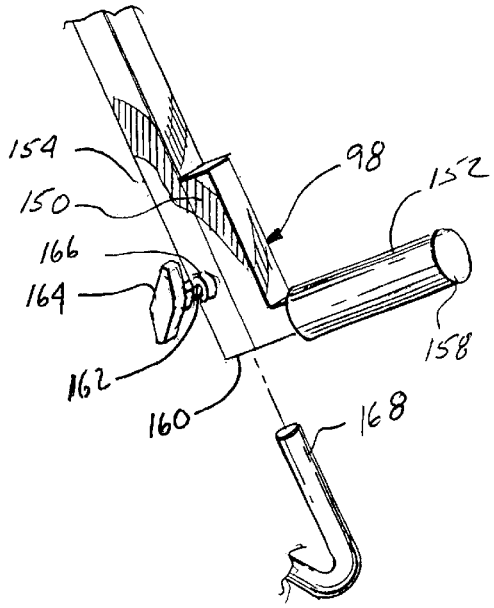
FIG. 12
FIG. 13
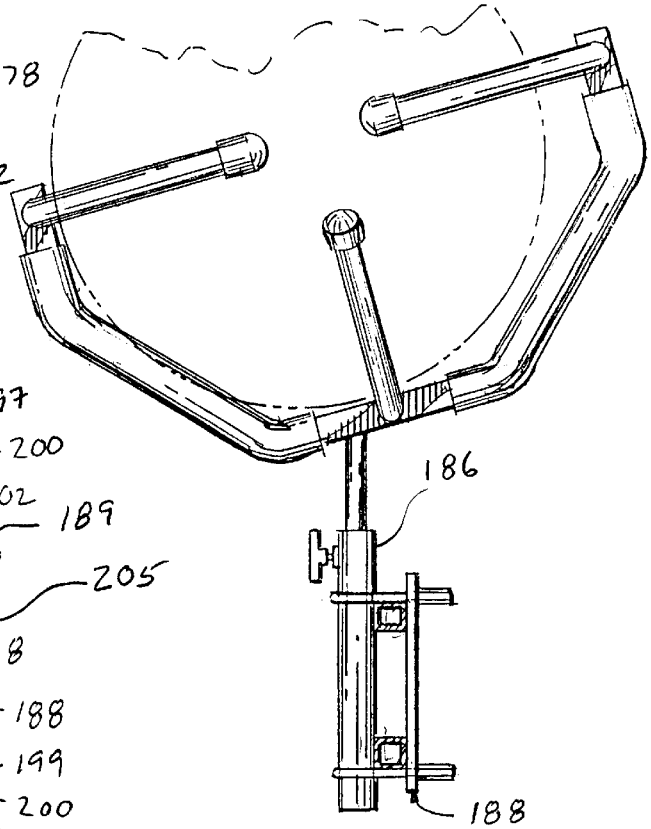
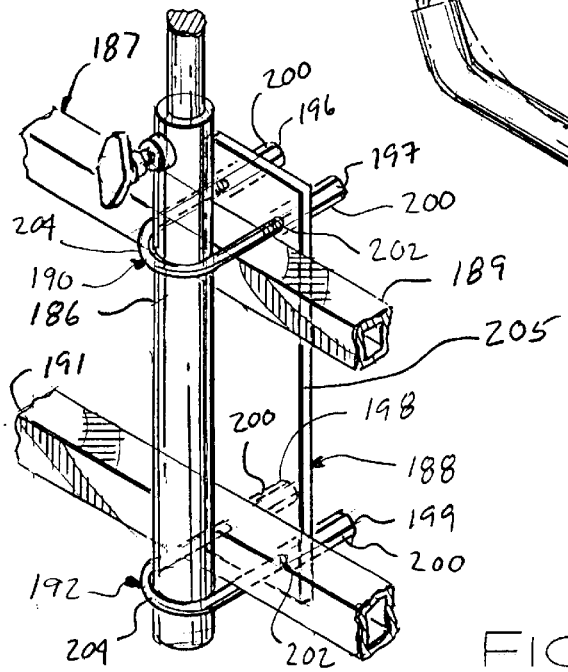
FIG. 14

MOBILE PERCUSSION INSTRUMENT FIELD RACK SYSTEM

BACKGROUND

This invention relates to mobile music racks of the type that transport and hold percussion instruments such as drums, cymbals, bells, xylophones, chimes, gongs, etc.

Typically, mobile field racks are used by marching bands and other musicians on marching fields at sporting or other such events. Some of these racks have been made so that they would be stationary and some have had wheels. Typically, users of the wheeled models have had problems transporting them to the place where the game is being played, as for use on the field during a halftime band performance. The racks are too wide and clumsy to handle to be transported easily, for example, in a school bus, even with a rear loading door. Another problem has been that the stands holding the percussion instruments do not typically attach firmly enough to the rack system and tend to loosen, etc. And there have been further problems attaching and using specific instruments, e.g., bass drums.

OBJECTS OF THE INVENTION

A primary object and feature of the present invention is to provide an improved system for a mobile field rack that holds a multiplicity of percussion instruments. It is a further object and feature of the present invention to provide such a system that permits a number of percussionist to play at the same time. It is still another object and feature of the present invention to provide such a system which is easily transported. It is yet another object and feature of the present invention to provide such a system which is stable and comprises a distinct upper and lower framework which may be independently adjusted. It is an even further object and feature of the present invention to provide such a system which utilizes a two-point clamping system for improved securing of the instruments.

A further primary object and feature of the present invention is to provide such a system which is efficient, inexpensive, and handy. Other objects and features of this invention will become apparent with reference to the following descriptions.

SUMMARY OF THE INVENTION

According to a preferred embodiment of the present invention, it provides a mobile percussion rack system comprising, in combination: a rack for supporting a plurality of percussion instruments; wherein such rack comprises a substantially-longitudinal first arrangement; wheels, having axles, for stably supporting such rack when such axles are in a transverse position; a rotator structured and arranged to rotate such axles into a longitudinal position in-line with such rack; wherein a narrow package for non-use transport of such rack system may be provided when such rack comprises such first arrangement and such axles are rotated into such longitudinal position. And it provides such a system wherein such rack further comprises end elements structured and arranged to place such rack in a non-longitudinal second arrangement. It further provides such a system wherein such rack further comprises a center section having: at least one first upper bar; at least one first lower bar.

In addition, it provides such a system wherein such end elements further comprise: a right section comprising at least one second upper bar and at least one second lower bar; a left section comprising at least one third upper bar and at least one third lower bar. And it provides such a system further comprising at least one height adjuster for adjusting the height of such center section. Also, it provides such a system further comprising at least one height adjuster for adjusting the height of such left section and such right section. And it provides such a system further comprising a vertical bracket attachable to both one such upper bar and one such lower bar, wherein such vertical bracket is structured and arranged to assist attachment of percussion instruments to such vertical bracket. It also provides such a system further comprising a horizontal bracket attachable at two places to one such upper bar, wherein such horizontal bracket is structured and arranged to assist attachment of percussion instruments to such horizontal bracket.

Moreover, this invention provides such a system wherein such center section, such left section and such right section are structured and arranged to provide two-point support of the percussion instruments. And it provides such a system wherein such rotator comprises: a right corner assembly; a left corner assembly; wherein such right corner assembly is structured and arranged to allow such right section to swivel in either direction such that such right section may be placed adjacent to and in about a longitudinal alignment with such center section; wherein such left corner assembly is structured and arranged to allow such left section to swivel in either direction such that such left section may be placed adjacent to and in about a longitudinal alignment with such center section. It further provides such a system wherein: such wheels further comprise four individual wheels, separated into a first two-wheel assembly and a second two-wheel assembly, each two-wheel assembly having a first independent rotating vertical axle and each wheel having a second independent vertical rotating axle; wherein one of each respective such first independent rotating vertical axles is attached to a respective such corner assembly; wherein such right corner assembly is structured and arranged to allow such first independent rotating vertical axle to swivel in either direction such that such two-wheel assembly may rotate a full 360 degrees; and wherein such left corner assembly is structured and arranged to allow such first independent rotating vertical axle to swivel in either direction such that such two-wheel assembly may rotate a full 360 degrees; and wherein such second independent vertical rotating axle is structured and arranged such that such wheels may rotate a full 360 degrees; whereby, such two-wheel assemblies may be rotated to be transversely positioned to such center section for stably supporting such rack system or rotated to be longitudinally positioned to such center section to facilitate a narrow package for non-use transport of such rack system.

Even in addition, it provides such a system further comprising at least one brake for blocking such wheels from moving. And it provides such a system wherein such end elements may be rotated outward to allow more room for multiple musicians to utilize the rack system without affecting the rack system wheelbase. It also provides such a system further comprising a bass drum holder structured and arranged to: be placed on the rack system at about a 45 degree angle; have an adjustable cross-bar structure; and allow such bass drum to rest flat against such cross-bar structure. Also, it provides such a system further comprising a plurality of percussion instruments attached to such rack. And it provides such a system wherein: such rack further comprises a center section, a right section, a left section, a right corner assembly, a left corner assembly, a left wheel assembly, a right wheel assembly, wherein such right wheel assembly comprises such right corner assembly and such left wheel assembly comprises such left corner assembly; wherein such center section is attached to such right corner assembly and such left corner assembly; wherein such right section is attached to such right corner assembly; wherein such left section is attached to such left corner assembly; wherein such right corner assembly is structured and arranged to allow such right section to swivel in either direction such that such right section may be placed adjacent to and in about a longitudinal alignment with such center section; and wherein such left corner assembly is structured and arranged to allow such left section to swivel in either direction such that such left section may be placed adjacent to and in about a longitudinal alignment with such center section. It also provides such a system wherein: such left corner assembly further comprises a locking bolt structured and arranged to stop swivel movement of such left section; and such right corner assembly further comprises a locking bolt structured and arranged to stop swivel movement of such right section.

Even moreover, according to a preferred embodiment thereof, this invention provides a mobile percussion rack system comprising, in combination: a rack for supporting a plurality of percussion instruments; wherein such rack comprises a substantially-longitudinal first arrangement; wheels, having axles, for stably supporting such rack when such axles are in a transverse position; a rotator structured and arranged to rotate such axles into a longitudinal position in-line with such rack; wherein a narrow package for non-use transport of such rack system may be provided when such rack comprises such first arrangement and such axles are rotated into such longitudinal position; wherein such rack further comprises end elements structured and arranged to place such rack in a non-longitudinal second arrangement; wherein such rack further comprises a center section having at least one first upper bar, at least one first lower bar; wherein such end elements further comprise a right section comprising at least one second upper bar, at least one second lower bar; a left section comprising at least one third upper bar, at least one third lower bar; at least one height adjuster for adjusting the height of such center section; at least one height adjuster for adjusting the height of such left section, and such right section; a vertical bracket attachable to both one such upper bar and one such lower bar, wherein such vertical bracket is structured and arranged to assist attachment of percussion instruments to such vertical bracket; and a horizontal bracket attachable at two places to one such upper bar, wherein such horizontal bracket is structured and arranged to assist attachment of percussion instruments to such horizontal bracket; wherein such center section, such left section and such right section are structured and arranged to provide two-point support of the percussion instruments; wherein such rotator comprises a right corner assembly, and a left corner assembly; wherein such right corner assembly is structured and arranged to allow such right section to swivel in either direction such that such right section may be placed adjacent to and in about a longitudinal alignment with such center section; wherein such left corner assembly is structured and arranged to allow such left section to swivel in either direction such that such left section may be placed adjacent to and in about a longitudinal alignment with such center section; wherein such wheels further comprise four individual wheels, separated into a first two-wheel assembly and a second two-wheel assembly, each two-wheel assembly having a first independent rotating vertical axle and each wheel having a second independent vertical rotating axle; wherein one of each respective such first independent rotating vertical axles is attached to a respective such corner assembly; wherein such right corner assembly is structured and arranged to allow such first independent rotating vertical axle to swivel in either direction such that such two-wheel assembly may rotate a full 360 degrees; wherein such left corner assembly is structured and arranged to allow such first independent rotating vertical axle to swivel in either direction such that such two-wheel assembly may rotate a full 360 degrees; and wherein such second independent vertical rotating axle is structured and arranged such that such wheels may rotate a full 360 degrees; whereby, such two-wheel assemblies may be rotated to be transversely positioned to such center section for stably supporting such rack system or rotated to be longitudinally positioned to such center section to facilitate a narrow package for non-use transport of such rack system; and wherein such end elements may be rotated outward to allow more room for multiple musicians to utilize the rack system without affecting the rack system wheelbase.

Additionally, this invention provides such a system further comprising: at least one brake for blocking such wheels from moving; and a bass drum holder structured and arranged to be placed on the rack system at about a 45 degree angle, have an adjustable cross-bar structure, and allow such bass drum to rest flat against such cross-bar structure. And ti provides such a system further comprising a plurality of percussion instruments attached to such rack.

BRIEF DESCRIPTION OF THE DRAWINGS

FIG. 11 is a side view, partially in section of the mounting bracket of the field rack tilting bass drum holder of the mobile percussion instrument field rack system, according to a preferred embodiment of the present invention.

FIG. 12 is a perspective exploded view of the mounting bracket of the field rack tilting bass drum holder of FIG. 11.

FIG. 13 is a perspective view, partially in section, of the crash cymbals holder along with a preferred embodiment of a vertical mounting bracket of the mobile percussion instrument field rack system, according to a preferred embodiment of the present invention.

FIG. 14 is a perspective view, partially in section, of the vertical mounting bracket illustrated in FIG. 13 of the mobile precussion instrument field rack system, according to a preferred embodiment of the present invention.

DETAILED DESCRIPTION OF THE BEST PREFERRED EMBODIMENT OF THE INVENTION

Figure 1:
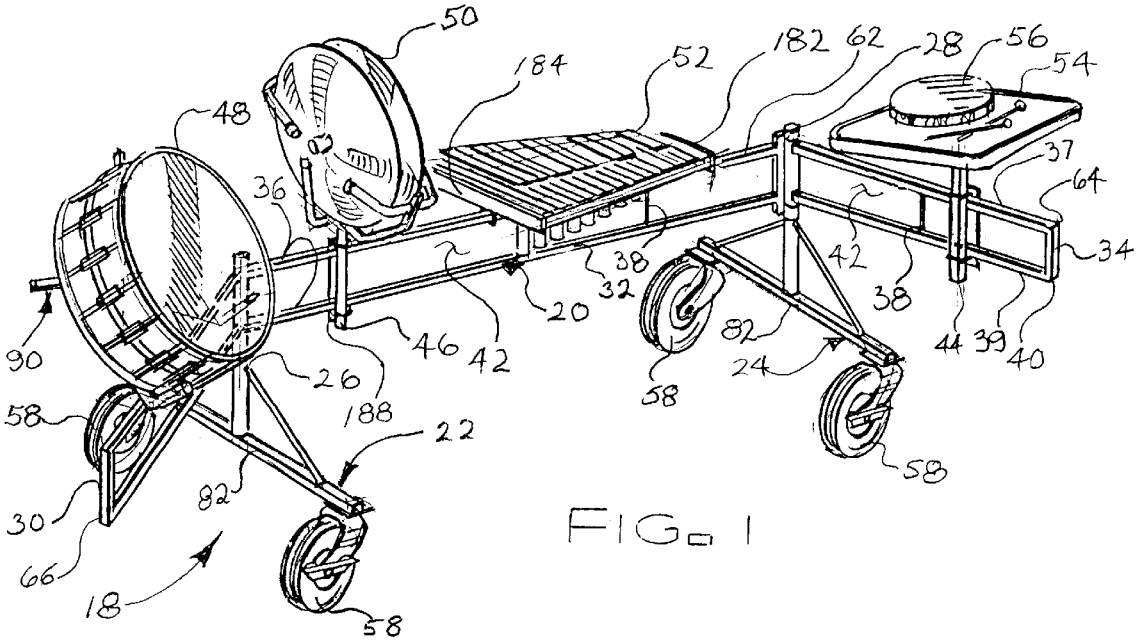
FIG. 1 is a perspective view of the mobile percussion instrument field rack system in an extended position according to a preferred embodiment of the present invention.

FIG. 1 is a perspective view of the mobile percussion instrument field rack system 18 in an extended position according to a preferred embodiment of the present invention. The mobile precussion instrument field rack system 18 is intended to be used at such musical field events as, for example, football half-time band-playing events and other such field events. These types of field events have unique problems in providing percussion instrument support and transport. The mobile percussion instrument field rack system 18 solves many of these problems as were described above in the background and as will be described further below. Preferably, the mobile percussion instrument field rack system 18 consists of an upper metal framework sub-assembly 20. The upper metal framework sub-assembly 20 is connected to wheelbase sub-assemblies 22 and 24 by swivel corner sub-assemblies 26 and 28. These corner sub-assemblies 26 and 28 will be discussed in greater detail with regards to FIGS. 4–8 below. Preferably, the upper metal framework sub-assembly 20 is comprised of three horizontal double-bar tubing sections 30, 32 and 34 as shown. Preferably, the double-bar tubing sections 30, 32 and 34 (embodying herein wherein such center section, such left section and such right section are structured and arranged to provide two-point support of the percussion instruments) are comprised of two horizontal sections of one-inch square tubing 36, an upper section 37 (embodying herein an upper bar) and a lower section 39 (embodying herein a lower bar). The tubing 36 is preferably weldably connected such that there are no protrusions that might interfere with the function of the mobile percussion instrument field rack system 18. Other methods of. firm connection may be employed by those knowledgeable in the art in appropriate circumstances. Preferably, section 32 is about six feet in length and sections 30 and 34 are each about two feet in length. Preferably, the horizontal one-inch tubing 36 is connected together by welding vertical support pieces 38 and one-inch tubing vertical end pieces 40, as shown (see also FIG. 8), such that the tubing is separated by about four and one-half inches in space 42. The support pieces 38 are preferably one-half inch round solid metal. Steel or anodized aluminum are preferred, but materials that would perform the intended functions with the intended durability may be employed by those knowledgeable in the art in appropriate circumstances. Preferably the use of the smaller diameter vertical support pieces 38 allows for increased flexibility when placing the musical instrument mounting brackets 44 and 46, which will be described in further detail in reference to FIGS. 11, 14 and the description below.

As further illustrated in FIG. 1, the mobile percussion instrument field rack system 18 comprises multiple musical instruments. Illustrated for representation of some of the possible instruments available are: base drum 48, cymbals 50, xylophone 52, and a trap table 54 (which may hold small items such items as a tambourine 56, or bells or other hand-held percussion instruments). Each of the above-described instruments is attached to the upper metal framework sub-assembly 20, as shown, by combination of each instruments standard instrument supports and the specialized mounting brackets 44 and 46, which are adaptable to the standard instrument supports (this arrangement embodying herein a plurality of percussion instruments attached to such rack).

Figure 2:
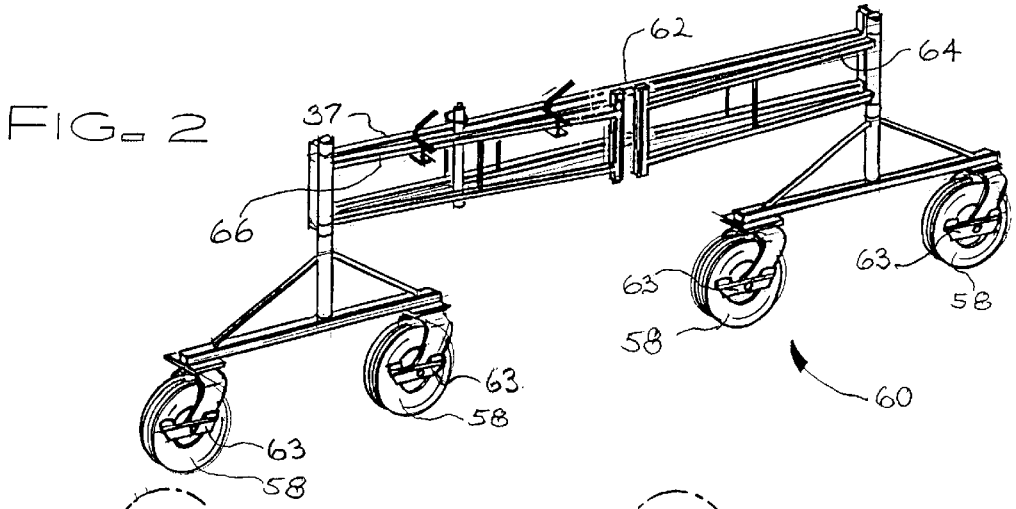
FIG. 2 is a perspective view of the mobile percussion instrument field rack system in a folded transporting position according to a preferred embodiment of the present invention.
Figure 3:
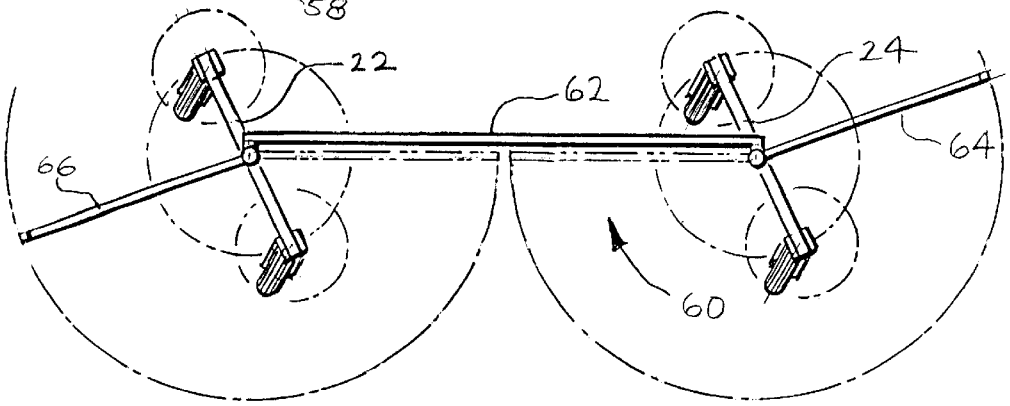
FIG. 3 is a diagrammatic plan view illustrating the swivel parameters of the mobile percussion instrument field rack system according to a preferred embodiment of the present invention.

FIG. 2 is a perspective view of the mobile percussion instrument field rack 60 (embodying herein a rack for supporting a plurality of percussion instruments) in a folded transporting position according to a preferred embodiment of the present invention. In this embodiment the field rack 60 is illustrated in a folded position (this arrangement embodying herein wherein a narrow package for non-use transport of such rack system may be provided when such rack comprises such first arrangement and such axles are rotated into such longitudinal position). Further illustrated by FIG. 3 is a diagrammatic plan view illustrating the swivel parameters of the mobile percussion instrument field rack system 18. The wheelbase sub-assemblies 22 and 24,swivel such that they are in an adjacent longitudinal alignment with the center portion 62 of the upper metal framework sub-assembly 20, as shown. In addition, the wheels 58 each have a vertical axle facilitating a 360 degree swivel and each wheel subassembly 22 and 24 has a vertical axle facilitating a 360 degree swivel. This arrangement provides that both the wheels 58 and wheel subassembly 22 and 24 may be aligned in a position substantially longitudinal to the center portion 62. There are preferably four wheels 58, two on each wheel subassembly 22 and 24 (this arrangement embodying herein such wheels further comprise four individual wheels, separated into a first two-wheel assembly and a second two-wheel assembly, each two-wheel assembly having a first independent rotating vertical axle and each wheel having a second independent vertical rotating axle). The wheels are preferably about ten inches in diameter, which raises the wheelbase crossbar member 82 to a preferable height of twelve inches above the ground. Preferably, each of the wheels 58 have a brake mechanism 63 which allows each individual wheel 58 to be locked into position or unlocked for movement and swivel purposes (embodying herein at least one brake for blocking such wheels from moving). Both side portions 64 and 66 also swivel and fold such that they are substantially adjacent and in about a longitudinal position to the center portion 62. In this folded position the field rack 60, may be transported and stored in between the seats of a bus or other such transport vehicle (not shown). Another advantage of the capability of field rack 60 to swivel is that the field rack 60 may be opened up to a wide length, in the preferred embodiment, of about twelve feet or as small as about six feet, with two side portions 64 and 66 perpendicular to the center portion 62, or, a variety of other combined positions. This multiplicity of positioning allows for one or several musicians to use the field rack 60 at any given musical event (embodying herein wherein such end elements may be rotated outward to allow more room for multiple musicians to utilize the rack system without affecting the rack system wheelbase).

Figure 4:
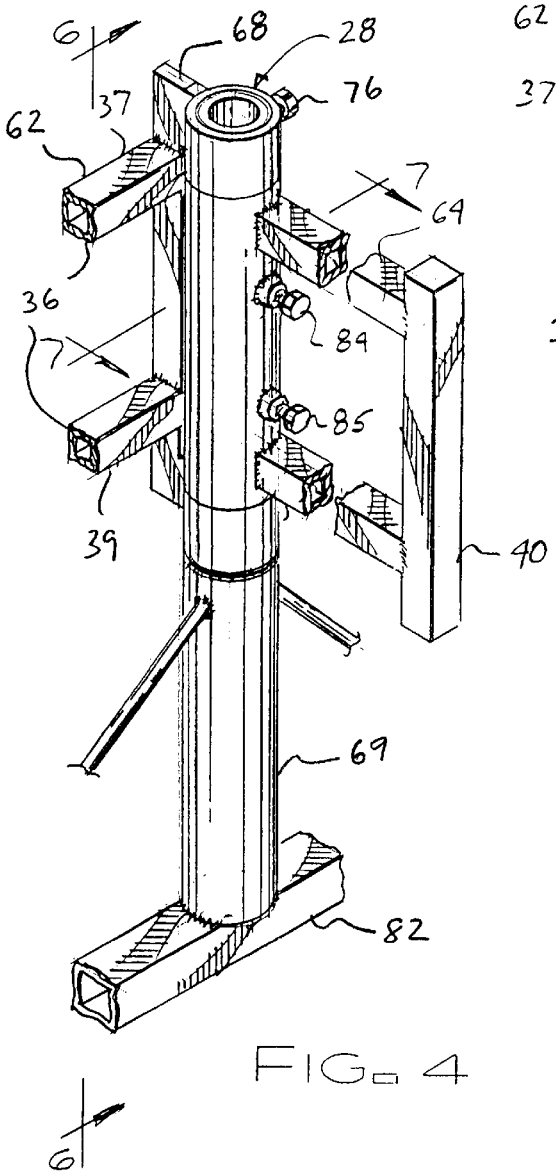
FIG. 4 is a partial perspective view, partially in section, of the wheel base stems and corner sub-assemblies of the mobile percussion instrument field rack system according to a preferred embodiment of the present invention.
Figure 5:
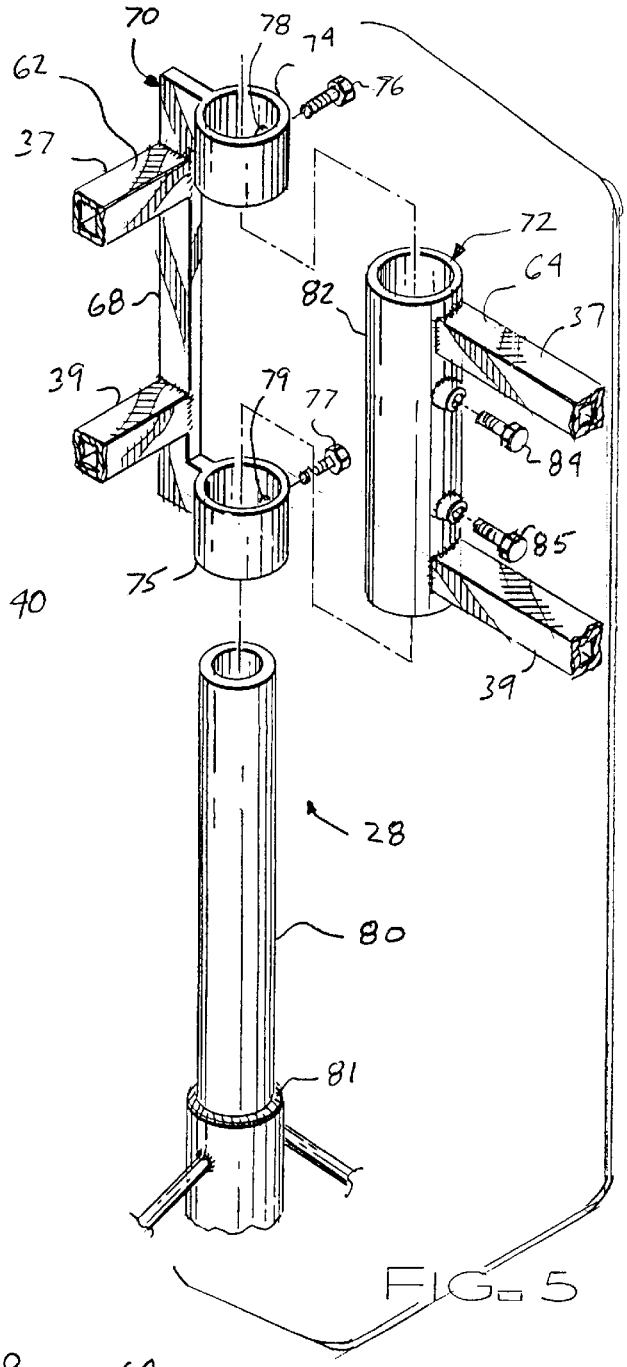
FIG. 5 is an exploded view of FIG. 4.
Figure 7:
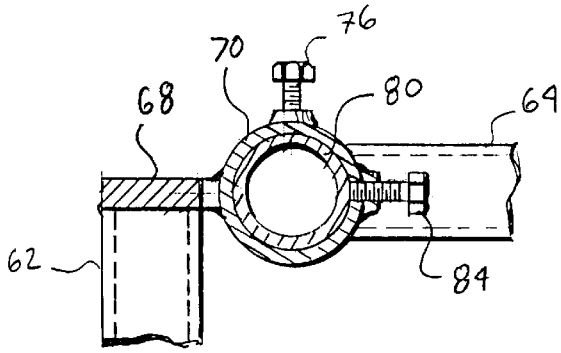
FIG. 7 is a cross-sectional plan view through section 7—7 of FIG. 4.

The unique ability of the mobile percussion instrument field rack system 18 to swivel is accomplished in part by the swivel corner sub-assemblies 26 and 28 (embodying herein a right corner assembly and a left corner assembly). FIG. 4 is a partial perspective view, partially in section, of the wheel base stem 69 and corner sub-assemblies 26 and 28 of the mobile percussion instrument field rack system 18 according to a preferred embodiment of the present invention. The corner sub-assemblies 26 and 28 are substantially similar with respect to their function and differ in their respective position as being left or right oriented to the center portion 62 (embodying herein wherein such right section is attached to such right corner assembly and wherein such left section is attached to such left corner assembly). FIG. 4 is shown with the center portion 62 to the left of the wheel base stem 69 indicating it is corner sub-assembly 28 (embodying herein wherein such center section is attached to such right corner assembly). The center portion 62 is preferably connected to the corner sub-assembly 28 by means of a flat, preferably three-eighths-inch-thick steel bar 68 which is preferably welded to both pieces, as shown in both FIG. 4 and FIG. 5. FIG. 5 and FIG. 7 illustrate the corner sub-assembly 28 further. Bar 68 is preferably part of sub-assembly 70 illustrated in FIG. 5. Preferably, sub-assembly 70 is comprised of an upper pipe portion 74 and a lower pipe portion 75 connected together by bar 68, as shown, such that both upper pipe portion 74 and lower pipe portion 75 share the same central axis. Preferably, both upper pipe portion 74 and lower pipe portion 75 are comprised of at least one-quarter-inch-thick steel pipe. The sub-assembly 70 is preferably mounted such that it fits over inner pipe element 80, thereby encircling inner pipe element 80 and having substantially the same central axis as upper pipe portion 74 and lower pipe portion 75. Preferably, inner pipe element 80 is at least three-eighths-inch-thick steel. In addition, upper pipe portion 74 and lower pipe portion 75 each have a single threaded aperture 78 and 79, respectively, into which a matching respective threaded bolt 76 and 77 will threadably insert into. Preferably, inner pipe element 80 is weldably attached by weld 81 to crossbar member 82, as shown in FIG. 1 and FIG. 4.

As inner pipe element 80 is preferably stationary, subassembly. 70 and sub-assembly 72 may rotate around the pipe element 80 (embodying herein wherein such right corner assembly is structured and arranged to allow such right section to swivel in either direction such that such right section may be placed adjacent to and in about a longitudinal alignment with such center section; and wherein such left corner assembly is structured and arranged to allow such left section to swivel in either direction such that such left section may be placed adjacent to and in about a longitudinal alignment with such center section). Preferably, sub-assembly 70 may be tightened into a fixed position around the pipe element 80 by tightening bolts 76 and 77 in well known ways. Preferably, sub-assembly 72 may be tightened into a fixed position around the pipe element 80 by tightening bolts 84 and 85 in well known ways (embodying herein such left corner assembly further comprises a locking bolt structured and arranged to stop swivel movement of such left section; and such right corner assembly further comprises a locking bolt structured and arranged to stop swivel movement of such right section). Those skilled in the art will recognize that there may be other means suitable for such tightening in appropriate circumstances. Preferably, sub-assembly 72 comprises a single pipe portion 82 which preferably has the same pipe diameter as upper pipe portion 74 and a lower pipe portion 75 such that, when placed over pipe element 80, both sub-assembly 70 and sub-assembly 72 share the same central axis and may rotate around the pipe element 80 with preferably minimal space between the pipe portions 74 and 75 and pipe element 80. As previously stated, sub-assembly 72 may be tightened into a fixed position around the pipe element 80 by tightening bolts 84 and 85 in well known ways. Preferably, sub-assembly 72 is tightened into a fixed position around the pipe element 80 by tightening bolts 84 and 85 when the side portion 64 (or 66 on the opposite side) is positioned (e.g. swung open such as in FIG. 1) to be used by the musician.

Figure 6:
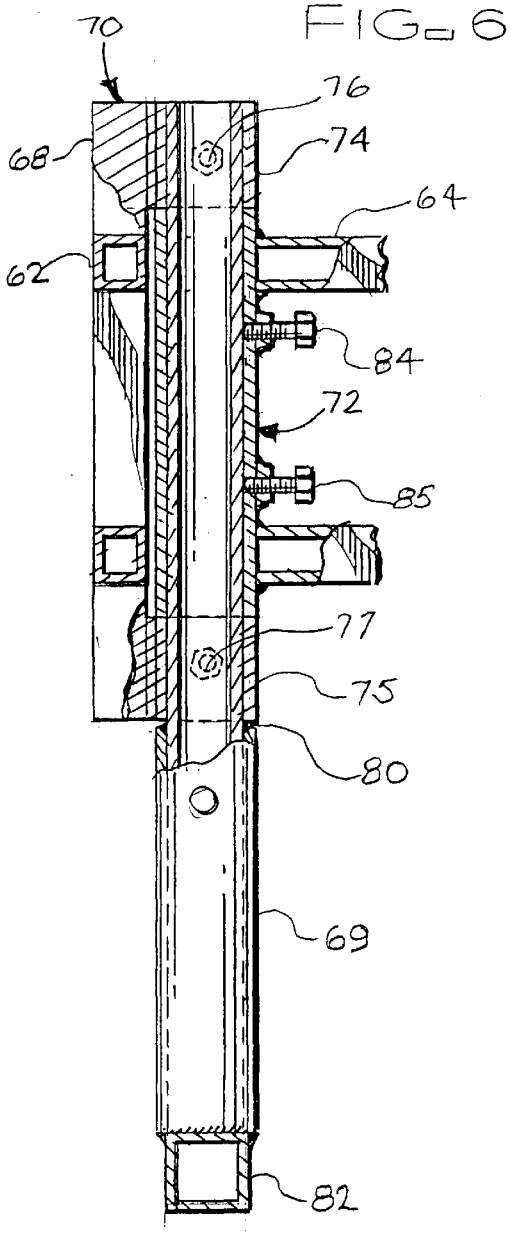
FIG. 6 is a cross-sectional plan view through section 6—6 of FIG. 4.

FIG. 6 is a cross-sectional plan view through section 6—6 of FIG. 4. FIG. 6 further illustrates corner sub-assembly 28 and the preferred positioning between sub-assembly 70, sub-assembly 72 and pipe element 80. FIG. 6 illustrates the preferred relationship described above wherein both sub-assembly 70 and sub-assembly 72 share the same central axis and rotate around the pipe element 80 with, preferably, minimal space between the pipe portions 74 and 75 and pipe element 80. Also shown is wheelbase sub-assembly 24 which rotates by rotating wheel base stem 69 around pipe element 80. This arrangement allows for a full 360 degrees of rotation for the wheelbase sub-assemblies 22 and 24 (embodying herein wherein such right corner assembly is structured and arranged to allow such first independent rotating vertical axle to swivel in either direction such that such two-wheel assembly may rotate a full 360 degrees; and wherein such left corner assembly is structured and arranged to allow such first independent rotating vertical axle to swivel in either direction such that such two-wheel assembly may rotate a full 360 degrees). As stated previously, the opposite wheelbase and corner sub-assembly, wheelbase sub-assembly 24, and corner sub-assembly 28 operate in a similar manner. FIG. 6 also illustrates the tightening bolts 84 and 85 as they would appear in a tightened mode. As tightening bolts 84 and 85 are pressed against pipe element 80 they produce a friction "clamp" on the pipe element 80 such that movement of the side portion 64 (in this illustration) is frictionally held from moving around pipe element 80.

FIG. 7 is a cross-sectional plan view through section 7—7 of FIG. 4. FIG. 71 illustrates the preferred relationship described above wherein both sub-assembly 70 and sub-assembly 72 share the same central axis and rotate around the pipe element 80 with preferably, minimal space between the pipe portions 74 and 75 and pipe element 80. Although only sub-assembly 72 is visible in this illustration, the preferred spacing for sub-assembly 70 is similar. Also illustrated are tightening bolt 76 and tightening bolt 84. Only tightening bolt 84 is shown in a tightened position against pipe element 80. In the illustrated position sub-assembly 72 would be tightened such that side portion 64 is perpendicular to center portion 62.

Figure 8:
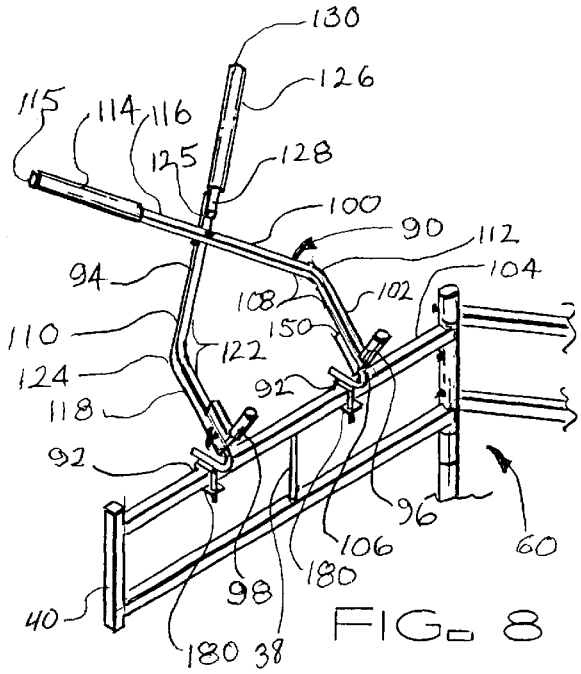
FIG. 8 is a perspective view of the field rack tilting bass drum holder of the mobile percussion instrument field rack system according to a preferred embodiment of the present invention.
Figure 9:
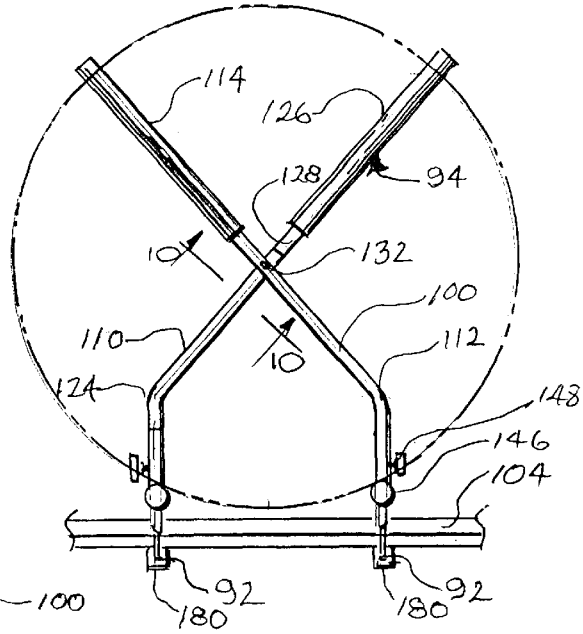
FIG. 9 is a front view of the field rack tilting bass drum holder of the mobile percussion instrument field rack system, according to a preferred embodiment of the present invention.

Reference is now made to both FIG. 8 and FIG. 9. FIG. 8 is a perspective view of the field rack tilted bass drum holder 90 (embodying herein a bass drum holder) of the mobile percussion instrument field rack system 18 according to a preferred embodiment of the present invention. FIG. 9 is a front view of the field rack tilting bass drum holder 90 of the mobile percussion instrument field rack system 18, according to a preferred embodiment of the present invention. In this embodiment, a tilted bass drum holder 90 is provided with two adaptive clamps 92 for attachment to the mobile percussion instrument field rack 60 at about a 45 degree angle (embodying herein a bass drum holder structured and arranged to be placed on the rack system at about a 45 degree angle). The tilting bass drum holder 90 comprises a folding X-frame 94, as shown (embodying herein a cross-bar structure). In addition, the folding X-frame 94 comprises two mounting brackets 96 and 98. Mounting brackets 96 and 98 will be discussed in greater detail in FIG. 11 and FIG. 12 below. Preferably, the X-frame 94 is made from one-inch square tubing. Preferably, the top leg 100 of the X-frame 94 consists of a straight portion 102 that is perpendicular to the top rail 104 of the mobile percussion instrument fieldirack 60. Approximately six and one-half inches from the bottom 106 of the straight portion 102, the top leg 100 bends at an angle 108 of 45 degrees inward towards the other bottom leg 110, as shown. Preferably the top leg 100 extends about two and one-half feet past the bend 112 (may be variable, depending on the drum size that one expects to accommodate). Preferably, a round rubber tubing 114 is applied over the one-inch square tubing at the end portion 116 of the top leg 100. Preferably, the rubber tubing 114 is at least one-quarter inch thick soft rubber tubbing. Those knowledgeable in the art will be able to select an acceptable soft tubing without undue experimentation. The rubber tubing 114 is used to cushion the base drum 48 (see FIG. 1) when it is placed onto the tilted bass drum holder 90. Preferably, the round rubber tubing 114 extends about 16 inches from the end 115 of the top leg 100.

The bottom leg 110 also consists of a straight portion 118 that is perpendicular to the top rail 104 of the mobile percussion instrument field rack 60. Approximately six and one-half inches from the bottom 120 of the straight portion 118, the bottom leg 110 bends at an angle 122 of 45 degrees inward towards the top leg 100, as shown. Preferably the bottom leg 110 extends about two and one-half feet past the bend 124 (made variable to depend on the drum size that one expects to accommodate); however, the bottom leg 110 is split approximately four inches past the bend 124. Preferably, a separate one and one-half foot piece of one-inch square tubing is added to the top 125 of the bottom leg 110, overlapping the four inch protrusion and thereby allowing the base drum 48 to set on the tilted bass drum holder 90 in a single flat plane (embodying herein such bass drum to rest flat against such cross-bar structure). Preferably, a round rubber tubing 126 is applied over the one-inch square tubing at the end portion 128 of the bottom leg 110. Preferably, the round rubber tubing 126 extends about 16 inches from the end 130 of the bottom leg 110.

Figure 10:
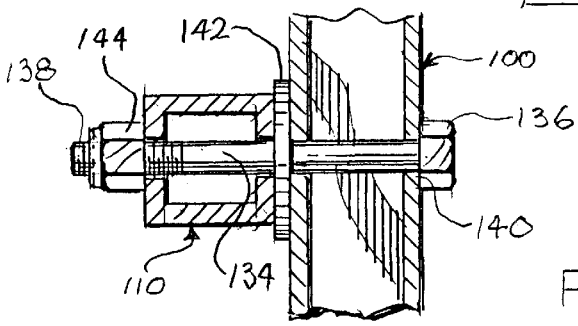
FIG. 10 is a cross-sectional view through section 10—10 of FIG. 9 illustrating the tilting bass drum holder hinge.

FIG. 10 is a cross-sectional view through section 10—10 of FIG. 9 illustrating the hinge attachment 132 of the tilting bass drum holder 90. Preferably, the top leg 100 and bottom leg 110 are connected together by hinge attachment 132. Preferably, hinge attachment 132 is a single attachment comprising a two and one-half inch long, three-eighth-inch thick machine bolt 134. Machine bolt 134 preferably has a hex head 136 on one end and a threaded bolt 138 on the other end, as shown. Preferably, the machine bolt.134 is placed through a pre-drilled hole 140, which extends through both the top leg 100 and bottom leg 110. Preferably a one inch steel washer 142 is placed onto the machine bolt 134 and placed between the top leg 100 and bottom leg 110 as shown. A nut 144 is then preferably threaded onto the bolt 134 and tightened such that the top leg 100 and bottom leg 110 are pressed together. The nut tightening may be adjusted, in well known ways, such that the top leg 100 and bottom leg 110 will be able to be moved at the hinge attachment 132.

FIG. 11 is a side view, partially in section, of the two mounting brackets 96 and 98 of the field rack tilting bass drum holder 90 of the mobile percussion instrument field rack system 18, according to a preferred embodiment of the present invention. FIG. 12 is a perspective exploded view of the mounting brackets 96 and 98 of the field rack tilting bass drum holder 90 of FIG. 11. Preferably, mounting bracket 96 comprises a short piece 146 of one inch square tubing, approximately three and one-half inches in length, which is weldably attached perpendicular to the lower end of the top leg 100. Piece 146 is then covered with round rubber tubing 152 (similar to that shown in FIG. 12). A separate short piece 150 of one-inch-square tubing, approximately three and one-half inches in length, is weldably attached onto the back side 154 of the top leg 100 (represented by dotted lines in FIG. 12). Preferably, mounting bracket 98 comprises a short piece 158 of one-inch-square tubing, approximately three and one-half inches in length, which is weldably attached perpendicular to the lower end 160 of the bottom leg 110. Piece 158 is then covered with round rubber tubing 152. A threaded bolt 162 with a handle tightening cap 164 attached is threaded into an aperture 166 which will allow the bolt 162 to be tightened against rod 168 which is attached to adaptive clamp 92 as shown in FIG. 12. Preferably, rod 168 is a solid one-half inch steel rod which is bent in a 45 degree angle. Preferably, rod 168 is weldably attached to adaptive clamp 92, which is clamped to field rack 60. Preferably, the one-inch-square tubing on the bottom leg 110 is open at the lower end 160. The opposite short piece 150 of one-inch-square tubing attached onto the back side 154 of the top leg 100 is also open at the lower end such that the X-frame 94 will slide over the two rods 168, thereby holding the tilting bass drum holder 90 at a 45-degree angle on the field rack 60.

This configuration, as described above, with one mounting bracket 96 having a extra short piece of tubing 150 along the back and one mounting bracket 98 having the extra piece of tubing 150 in the front, combined with the off-set tubing on the bottom leg 110, allows for the base drum 48 to sit firmly in a plane as it rests on the tilting bass drum holder 90.

Reference is now made to the adaptive clamp 92 (embodying herein a horizontal bracket attachable at two places to one such upper bar, wherein such horizontal bracket is structured and arranged to assist attachment of percussion instruments to such horizontal bracket) shown in FIG. 11 and FIG. 12. Preferably, adaptive clamp 92 is comprised of a single one-quarter-inch piece of round steel bent into a U-shape 174, such that the clamp will fit over one-inch square tubing 176, as shown in FIG. 11, and threaded at both open ends 170 and 172. Preferably, each threaded end 170 and 172 has a threaded nut 178 which may be tightened by hand or wrench. In addition, a one-quarter-inch steel plate 180 (see FIG. 8) approximately one inch wide by two and one-half inches long is placed between the clamp and the one-inch-square tubing 176 to further stabilize the tilting bass drum holder 90 on the field rack 60. Adaptive clamp 92 may be used to attach any of the musical instruments holders in a horizontal manner on the upper section 37 of the field rack 60 (also shown in FIG. 1). Another example of a horizontal musical instruments holder attached by the adaptive clamp 92 is the xylophone 52. The xylophone 53 used two pieces of opposing right-angled steel brackets 182 and 184 to hold the xylophone 52 flat. By connecting adaptive clamps 92 to these brackets 182 and 184, the standard xylophone brackets 182 and 184 may be adapted for use on the field rack 60.

Reference is now made to FIG. 13 and FIG. 14. FIG. 13 is a perspective view, partially in section, of crash cymbals holder 185 along with a preferred embodiment of a vertical mounting bracket 188 of the mobile percussion instrument field rack system 18, according to a preferred embodiment of the present invention. FIG. 14 is a perspective view, partially in section, of the mounting bracket illustrated in FIG. 13 of the mobile percussion instrument field rack system 18, according to a preferred embodiment of the present invention. Several types of percussion instruments use a telescopic vertical rod 186 to hold the instruments, including the crash cymbals holder 185, as shown. The mobile percussion instrument field rack system 18 provides a vertical mounting bracket 188 (embodying herein a vertical bracket attachable to both one such upper bar and one such lower bar, wherein such vertical bracket is structured and arranged to assist attachment of percussion instruments to such vertical bracket) for use with the telescopic vertical rod 186 and double-bar tubing section 187 (comprising two horizontal sections of one-inch-square tubing, an upper section 189 and a lower section 191). Preferably, vertical mounting bracket 188 comprises two U-shaped clamps 190 and 192. Both U-shaped clamps 190 and 192 are comprised of a single one-quarter inch round piece of steel bent into a U-shape such that the clamp will fit around vertical mounting bracket 188, as shown in FIG. 14. Preferably, both ends 196 and 197 of the U-shaped clamp 190 and ends 198 and 199 of the U-shaped clamp 192 are threaded such that they will receive threaded nuts 200. Preferably, a one-quarter inch thick steel plate 205 approximately two inches wide by seven inches long is provided with apertures 202 formed such that each end 196 and 197 of the U-shaped clamp 190 and ends 198 and 199 are inserted through the apertures. Preferably, the telescopic vertical rod 186 is slidably inserted through the U-shaped portion 204 of clamps 190 and 192, as shown in FIG. 14, and the steel plate 205 is placed on the opposite side of the double-bar tubing section 187 as shown. U-shaped clamps 190,and 192 are then tightened, drawing the U-shaped portion 204 tight against the telescopic vertical rod 186 and both the upper section 189 and lower section 191 of double-bar tubing section 187. The vertical mounting bracket 188 provides a stable and constant force on the vertical rod 186 (solving a described problem in the prior art).

In operation, and represented by FIG. 1 and FIG. 2, the mobile percussion instrument field rack system 18 functions, in one preferred embodiment, as follows. The field rack 60 is opened up by swiveling the wheelbase sub-assemblies 22 and 24 to a preferred position perpendicular to the center portion 62, also shown as horizontal double-bar tubing section 32. The field rack 60 is then further opened up by loosening bolts 84 and 85 on sub-assembly 72 and swiveling side portions 64 and 66, also shown. as horizontal double-bar tubing sections 30 and 34, out to the desired field playing position to allow a multiple of musicians to utilize the field rack 60, which, for purposes of explanation, will be as shown in FIG. 1. After the horizontal double-bar tubing sections 30 and 34 are set to the desired field playing position, bolts 84 and 85 on sub-assembly 72 are tightened. Preferably, the musical percussion instruments that are to be played using the rack are then installed on the field rack 60 in the desired position. For example, FIG. 1 illustrates the base drum 48 installed on the field rack tilting bass drum holder 90, which is mounted on-horizontal double-bar tubing section 30. The cymbals 50 and xylophone 52 are mounted on center tubing section 30. The cymbals 50 are mounted to the horizontal double-bar tubing using mounting bracket 188. The xylophone 52 is mounted using two pieces of opposing right angled steel brackets 182 and 184 to hold the xylophone 52 flat and then utilizing adaptive clamps 92 connected to these brackets 182 and 184 and attaching to the upper section 189 of double-bar tubing section 187. Trap table 54 which holds small items such items as a tambourine 56, or bells (not shown) or other hand-held percussion instruments is shown attached to horizontal double-bar tubing section 34. Preferably, the trap table 54 is also attached to the horizontal double-bar tubing using mounting bracket 188 as shown in FIG. 1.

Each of the above-described instruments is attached to the upper metal framework sub-assembly 20. This sub-assembly 20 may be further adjusted in height, if desired, by raising the entire sub-assembly 20 at each of the corner sub-assemblies 26 and 28 This arrangement embodying herein at least one height adjuster for adjusting the height of such center section; and at least one height adjuster for adjusting the height of such left section; and such right section). As each corner sub-assemblies 26 and 28 is raised by lifting the assembly up on pipe element 80 and tightening all the associated bolts 76, 77, 84 and 85, the entire sub-assembly 20 may be raised. Although not shown, the pipe element 80 may be lengthened in height to allow for an increased height adjustability, if so desired.

After all of the instrument placements have been made, the instruments may be removed, leaving the various mounting brackets and clamps in place as shown in FIG. 2. Preferably, in this manner, the instruments can be carried or transported in their normal manner and the field rack 60 may be folded by reversing the opening up process described above. That is, loosening the corner sub-assemblies 26 and 28 bolts and folding the horizontal double-bar tubing sections 30 and 34, also shown as side portions 64 and 66, inwards toward the center portion 62, also shown as double-bar tubing sections 32 and swiveling the wheelbase sub-assemblies 22 and 24 to a preferred position in an adjacent longitudinal alignment with the center portion 62 of the upper metal framework sub-assembly 20, as shown. In addition the wheels 58 also swivel and may be aligned in a position substantially longitudinal to the center portion 62. The field rack 60 is now in a position to be stored and transported in a minimal amount of space as may occur when transported between the seats of a school bus.

Although applicant has described applicant's preferred embodiments of this invention, it will be understood that the broadest scope of this invention includes such modifications as diverse shapes and sizes and materials. Such scope is limited only by the below claims as read in connection with the above specification.

Further, many other advantages of applicant's invention will be apparent to those skilled in the art from the above descriptions and the below claims.

What is claimed is:

1. A mobile percussion rack system comprising, in combination:

a) a rack structured and arranged to support a plurality of percussion instruments;

b) wherein said rack comprises a substantially-longitudinal first arrangement;

c) wheels, having axles, structured and arranged to stably support said rack when said axles are in a transverse position; and d) a rotator structured and arranged to rotate said axles into a longitudinal position in-line with said rack;

e) wherein a narrow package for non-use transport of said rack system may be provided when said rack comprises said first arrangement and said axles are rotated into said longitudinal position;

f) wherein said positions of said axles can be arranged either to stably support said rack or to compactly transport said rack, independently of rack arrangement.

2. The mobile percussion rack system of claim 1 wherein said rack further comprises end elements structured and arranged to place said rack in a non-longitudinal second arrangement.

3. A mobile percussion rack system comprising, in combination:

a) a rack structured and arranged to support a plurality of percussion instruments;

b) wherein said rack comprises a substantially-longitudinal first arrangement;

c) wheels, having axles, structured and arranged to stably support said rack when said-axles are in a transverse position; and d) a rotator structured and arranged to rotate said axles into a longitudinal position in-line with said rack;

e) wherein a narrow package for non-use transport of said rack system may be provided when said rack comprises said first arrangement and said axles are rotated into said longitudinal position;

f) wherein said rack further comprises end elements structured and arranged to place said rack in a non-longitudinal second arrangement;

g) wherein said rack further comprises a center section having:

i) at least one first upper bar; and ii) at least one first lower bar.

4. The mobile percussion rack system of claim 3 wherein said end elements further comprise:

a) a right section comprising i) at least one second upper bar, and ii) at least one second lower bar; and b) a left section comprising i) at least one third upper bar, and ii) at least one third lower bar.

5. The mobile percussion rack system of claim 4 further comprising at least one height adjuster structured and arranged to adjust the height of said center section.

6. The mobile percussion rack system of claim 5 further comprising at least one height adjuster structured and arranged to adjust the height of a) said left section, and b) said right section.

7. The mobile percussion rack system of claim 4 further comprising a vertical bracket attachable to both one said upper bar and one said lower bar, wherein said vertical bracket is structured and arranged to assist attachment of percussion instruments to said vertical bracket.

8. The mobile percussion rack system of claim 4 further comprising a horizontal bracket attachable at two places to one said upper bar, wherein said horizontal bracket is structured and arranged to assist attachment of percussion instruments to said horizontal bracket.

9. The mobile percussion rack system of claim 4 wherein said center section, said left section and said right section are structured and arranged to provide two-point support of the percussion instruments.

10. The mobile percussion rack system of claim 2 wherein said rotator comprises:

a) a right corner assembly; and b) a left corner assembly;

c) wherein said right corner assembly is structured and arranged to allow said right section to swivel in either direction such that said right section may be placed adjacent to and in about a longitudinal alignment with said center section; and d) wherein said left corner assembly is structured and arranged to allow said left section to swivel in either direction such that said left section may be placed adjacent to and in about a longitudinal alignment with said center section.

11. The mobile percussion rack, system of claim 1 wherein:

a) said wheels further comprise four individual wheels, separated into a first two-wheel assembly and a second two-wheel assembly, each two-wheel assembly having a first independent rotating vertical axle and each wheel having a second independent vertical rotating axle;

b) one of each respective said first independent rotating vertical axles is attached to a respective said corner assembly;

c) said right corner assembly is structured and arranged to allow said first independent rotating vertical axle to swivel in either direction such that said two-wheel assembly may rotate a full 360 degrees; and d) said left corner assembly is structured and arranged to allow said first independent rotating vertical axle to swivel in either direction such that said two-wheel assembly may rotate a full 360 degrees; and e) said second independent vertical rotating axle is structured and arranged such that said wheels may rotate a full 360 degrees;

f) whereby said two-wheel assemblies may be i) rotated to be transversely positioned to said center section for stably supporting said rack system or ii) rotated to be longitudinally positioned to said center section to facilitate a narrow package for non-use transport of said rack system.

12. The mobile percussion rack system of claim 11 further comprising at least one brake structured and arranged to block said wheels from moving.

13. The mobile percussion rack system of claim 10 wherein said end elements may be rotated outward to allow more room for multiple musicians to utilize the rack system without affecting the rack system wheelbase.

14. The mobile percussion rack system of claim 13 further comprising a bass drum holder structured and arranged to:

a) be placed on the rack system at about a 45-degree angle;

b) have an adjustable cross-bar structure; and c) allow said bass drum to rest flat against said cross-bar structure.

15. The mobile percussion rack system of claim 1 further comprising a plurality of percussion instruments attached to said rack.

16. The mobile percussion rack system of claim 1 wherein:

a) said rack further comprises:

i) a center section, ii) a right section, iii) a left section, iv) a right corner assembly, v) a left corner assembly, vi) a left wheel assembly, and vii) a right wheel assembly;

b) said right wheel assembly comprises said right corner assembly and said left wheel assembly comprises said left corner assembly;

c) said center section is attached to said right corner assembly and said left corner assembly;

d) said right section is attached to said right corner assembly;

e) said left section is attached to said left corner assembly;

f) said right corner assembly is structured and arranged to allow said right section to swivel in either direction such that said right section may be placed adjacent to and in about a longitudinal alignment with said center section; and g) said left corner assembly is structured and arranged to allow said left section to swivel in either direction such that said left section may be placed adjacent to and in about a longitudinal alignment with said center section.

17. The mobile percussion rack system of claim 16 wherein;

a) said left corner assembly further comprises at least one locking bolt structured and arranged to stop swivel movement of said left section; and b) said right corner assembly further comprises at least one locking bolt structured and arranged to stop swivel movement of said right section.

18. A mobile percussion rack system comprising, in combination:

a) a rack structured and arranged to support a plurality of percussion instruments;

b) wherein said rack comprises a substantially-longitudinal first arrangement;

c) wheels, having axles, structured and arranged to stably support said rack when said axles are in a transverse position;

d) a rotator structured and arranged to rotate said axles into a longitudinal position in-line with said rack;

e) wherein a narrow package for non-use transport of said rack system may be provided when said rack comprises said first arrangement and said axles are rotated into said longitudinal position;

f) wherein said rack further comprises end elements structured and arranged to place said rack in a non-longitudinal second arrangement;

g) wherein said rack further comprises a center section having
i) at least one first upper bar, and
ii) at least one first lower bar;

h) wherein said end elements further comprise
i) a right section comprising
(1) at least one second upper bar, and
(2) at least one second lower bar, and
i) a left section comprising
(1) at least one third upper bar, and
(2) at least one third lower bar;

j) at least one height adjuster structured and arranged to adjust the height of said center section;

k) at least one height adjuster structured and arranged to adjust the height of
i) said left section, and
ii) said right section l) a vertical bracket attachable to both one said upper bar and one said lower bar, wherein said vertical bracket is structured and arranged to assist attachment of percussion instruments to said vertical bracket; and m) a horizontal bracket attachable at two places to one said upper bar, wherein said horizontal bracket is structured and arranged to assist attachment of percussion instruments to said horizontal bracket;

n) wherein said center section, said left section and said right section are structured and arranged to provide two-point support of the percussion instruments;

o) wherein said rotator comprises
i) a right corner assembly, and
ii) a left corner assembly;

p) wherein said right corner assembly is structured and arranged to allow said right section to swivel in either direction such that said right section may be placed adjacent to and in about a longitudinal alignment with said center section;

q) wherein said left corner assembly is structured and arranged to allow said left section to swivel in either direction such that said left section may be placed adjacent to and in about a longitudinal alignment with said center section;

r) wherein said wheels further comprise four individual wheels, separated into a first two-wheel assembly and a second two-wheel assembly, each two-wheel assembly having a first independent rotating vertical axle and each wheel having a second independent vertical rotating axle;

s) wherein one of each respective said first independent rotating vertical axles is attached to a respective said corner assembly;

t) wherein said right corner assembly is structured and arranged to allow said first independent rotating vertical axle to swivel in either direction such that said two-wheel assembly may rotate a full 360 degrees;

u) wherein said left corner assembly is structured and arranged to allow said first independent rotating vertical axle to swivel in either direction such that said two-wheel assembly may rotate a full 360 degrees; and v) wherein said second independent vertical rotating axle is structured and arranged such that said wheels may rotate a full 360 degrees;

w) whereby, said two-wheel assemblies may be
i) rotated to be transversely positioned to said center section for stably supporting said rack system or
ii) rotated to be longitudinally positioned to said center section to facilitate a narrow package for non-use transport of said rack system; and x) wherein said end elements may be rotated outward to allow more room for multiple musicians to utilize the rack system without affecting the rack system wheelbase.

19. The mobile percussion rack system of claim 18 further comprising, a) at least one brake structured and arranged to block said wheel s from moving; and b) a bass drum holder structured and arranged to
i) be placed on the rack system at about a 45 degree angle,
ii) have an adjustable cross-bar structure, and
iii) allow said bass drum to rest flat against said cross-bar structure.

20. The mobile percussion rack system of claim 19 further comprising a plurality of percussion instruments attached to said rack.

21. A mobile percussion rack system comprising:

a) a bass drum holder structured and arranged to hold a bass drum and further comprising
i) a folding cross-bar structured and arranged to be adjustable in width to hold said bass drum;
ii) two mounting brackets structured and arranged to hold said bass drum holder at a 45-degree angle away from the user;
iii) rubber tubing structured and arranged to cove ends of said cross-bar to cushion said bass drum; and
iv) a tightening element structured and arranged to clamp said cross-bar to said mounting brackets; and b) at least one clamp element structured and arranged to connect said bass drum holder to the mobile percussion rack system.

* * * * *